US010578385B2

(12) United States Patent
Dextraze

(10) Patent No.: US 10,578,385 B2
(45) **Date of Patent: *Mar. 3, 2020**

(54) MULTI-STAGE TRIGGER MECHANISM FOR FIREARM

(71) Applicant: Serge Dextraze, St-Jean-sur-Richelieu (CA)

(72) Inventor: Serge Dextraze, St-Jean-sur-Richelieu (CA)

(73) Assignee: CADEQUIP, INC., St-Jean-sur-Richelieu (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/411,398

(22) Filed: Jan. 20, 2017

(65) Prior Publication Data

US 2017/0191776 A1 Jul. 6, 2017

Related U.S. Application Data

(63) Continuation-in-part of application No. 14/690,357, filed on Apr. 17, 2015, now Pat. No. 9,644,913.

(51) Int. Cl.

| | |
|---|---|
| ***F41A 19/16*** | (2006.01) |
| ***F41A 19/10*** | (2006.01) |
| ***F41A 19/12*** | (2006.01) |

(52) U.S. Cl.

CPC ..... *F41A 19/10* (2013.01); *F41A 19/12* (2013.01); *F41A 19/16* (2013.01)

(58) Field of Classification Search

CPC ..... F41A 19/10; F41A 19/12; F41A 19/31; F41A 19/25; F41A 19/24; F41A 19/16; F41A 19/11

See application file for complete search history.

(56) References Cited

U.S. PATENT DOCUMENTS

| | | | | | |
|---|---|---|---|---|---|
| 2,249,231 | A * | 7/1941 | Smith | F41A 19/16 | 42/69.02 |
| 2,249,232 | A * | 7/1941 | Smith | F41A 19/16 | 42/69.02 |
| 2,341,298 | A * | 2/1944 | Sweany | F41A 19/16 | 42/69.02 |
| 2,341,299 | A * | 2/1944 | Sweany | F41A 19/16 | 42/69.01 |
| 2,365,440 | A * | 12/1944 | Seitz | F41A 17/20 | 42/69.02 |
| 2,413,520 | A * | 12/1946 | Reising | F41A 19/10 | 42/69.02 |
| 2,584,299 | A * | 2/1952 | Sefried | F41A 19/31 | 42/69.02 |

(Continued)

*Primary Examiner* — Derrick R Morgan

(74) *Attorney, Agent, or Firm* — FisherBroyles LLP; Anthony Dovale

(57) ABSTRACT

A trigger mechanism for a firearm is presented. The trigger mechanism has a trigger housing, a sear, a sear block and a trigger lever. Actuation of the trigger causes the trigger lever to rotate and eventually come into contact and move the sear block, which permits the sear to fall and permits the actuation of the firing mechanism. The trigger lever may be pivotally secured to the housing at a first pivot and the sear block is pivotally secured to the housing at a second pivot. The first and second pivots may be spaced apart from each other or coincident.

19 Claims, 13 Drawing Sheets

(56) References Cited

U.S. PATENT DOCUMENTS 2,765,709 A * 10/1956 Hepperle ..... F41A 17/36 42/69.02
2,775,836 A * 1/1957 Emerson ..... F41A 19/31 42/69.02
3,103,758 A * 9/1963 Wilhelm ..... F41A 19/31 42/69.02
3,183,616 A * 5/1965 Gandy ..... F41A 19/16 42/69.02
3,899,845 A * 8/1975 Wild ..... F41A 19/10 124/31
3,950,876 A * 4/1976 Wild ..... F41A 19/32 42/69.01
4,058,924 A * 11/1977 Mullner ..... F41A 19/17 42/69.01
4,908,970 A * 3/1990 Bell ..... F41A 19/12 42/69.01
5,487,233 A * 1/1996 Jewell ..... F41A 19/16 42/69.01
5,615,507 A * 4/1997 French ..... F41A 17/28 42/69.02
6,865,838 B2 * 3/2005 Williams ..... F41C 9/08 42/51
7,181,880 B2 * 2/2007 Keeney ..... F41A 19/44 42/69.03
7,188,561 B1 * 3/2007 Kelbly ..... F41A 19/16 42/69.02
7,421,937 B1 * 9/2008 Gangl ..... F41A 17/46 42/69.03
8,132,349 B1 * 3/2012 Huber ..... F41A 19/16 42/69.01
8,220,193 B1 * 7/2012 Lynch ..... F41A 17/48 42/70.08
8,250,799 B2 * 8/2012 Duperry ..... F41A 19/16 42/42.02
8,631,600 B2 * 1/2014 Atzl ..... F41A 19/12 42/69.01
8,677,665 B1 * 3/2014 Huber ..... F41A 19/12 42/69.01
8,966,802 B1 * 3/2015 Findlay ..... F41A 19/12 42/69.01
9,046,313 B1 * 6/2015 Lutton ..... F41A 17/46
9,170,063 B2 * 10/2015 Krieger ..... F41A 19/10
9,194,639 B1 * 11/2015 Malheiros ..... F41A 19/32
9,267,750 B1 * 2/2016 Tubb ..... F41A 19/16
9,389,037 B2 * 7/2016 Reynolds ..... F41A 19/12
9,671,186 B1 * 6/2017 Hoekema ..... F41A 19/17
9,746,271 B2 * 8/2017 Hughes ..... F41A 33/02
9,759,504 B2 * 9/2017 Geissele ..... F41A 19/12
2005/0188580 A1 * 9/2005 Jewell ..... F41A 19/16 42/69.02
2010/0175291 A1 * 7/2010 Farley, Jr. ..... F41A 19/10 42/69.01
2011/0079137 A1 * 4/2011 Audibert ..... F41A 19/10 89/136
2011/0168008 A1 * 7/2011 Landies ..... F41A 19/10 89/128
2011/0277367 A1 * 11/2011 Krieger ..... F41A 19/10 42/69.01
2012/0227301 A1 * 9/2012 Simmons ..... F41A 19/10 42/69.01
2013/0167423 A1 * 7/2013 Lupher ..... F41A 17/06 42/70.06
2016/0047615 A1 * 2/2016 Tubb ..... F41A 17/56 42/69.01
2016/0061549 A1 * 3/2016 Patterson ..... F41A 17/56 42/69.01
2016/0116243 A1 * 4/2016 Hughes ..... F41A 19/10 124/31
2016/0305730 A1 * 10/2016 Dextraze ..... F41A 19/10
2016/0363401 A1 * 12/2016 Elftmann ..... F41A 19/15
2017/0089654 A1 * 3/2017 Findlay ..... F41A 3/66
2017/0336164 A1 * 11/2017 Lipowski ..... F41A 19/16

* cited by examiner

MULTI-STAGE TRIGGER MECHANISM FOR FIREARM

CROSS REFERENCE TO RELATED APPLICATION

This application is a continuation-in-part of U.S. patent application Ser. No. 14/690,357 filed on Apr. 17, 2015, the disclosure of which is hereby incorporated by reference.

FIELD OF THE INVENTION

This invention relates generally to a firearm trigger mechanism. More specifically, the invention relates to a multi-stage trigger mechanism preferably for a rifle.

BACKGROUND OF THE INVENTION

Firearm triggers now in use are designed for either single-stage or two-stage operation only and are limited to narrow ranges of trigger pull weights and travel. Design geometry requires removal of the receiver from the stock or the trigger from the receiver to affect significant changes in either weight or pull or trigger travel.

Every user of a firearm, such as a rifle, for highly accurate target or hunting purposes has a preferred trigger pull. Substantially all known trigger mechanisms have a spring bias imparted to the trigger to resist the pulling movement of the operator. The adjustment of the compression or tension forces in the spring opposing the movement of the trigger will provide an adjustment in resisting force of the trigger to the pulling action. Some shooters prefer what is known as a two-stage pull. In the first stage, the trigger moves against a pre-selected spring resistance to a position just short of that required to release the sear and effect the firing of the firearm. At the end of the first stage pull, the trigger encounters additional resistance which indicates to the operator that it is ready for firing with minimum additional trigger travel. The extent of such first stage pull and the amount of additional resistance imparted to the trigger upon entering the second stage is a matter of choice of the firearm operator. The two stage approach provides a level of safety without the use of a traditional safety mechanism.

SUMMARY

Presented herein is a trigger mechanism for a firearm. The invention is particularly suited for use in bolt action rifles, but with minor physical modifications could be more widely usable. In one aspect, the trigger mechanism comprises a trigger housing having a front, back, top, and bottom. In this aspect, the trigger housing has two spaced side plate elements mountable below a firing mechanism. The trigger mechanism also comprises a trigger assembly body therebetween a portion of the two spaced vertical plate elements;

The trigger mechanism also has a sear pivotally mounted between the plate elements and releasably engagable with a portion of the firing mechanism. The trigger mechanism comprises a sear block pivotally mounted between the plate elements at a sear block pivot and has a distal portion releasably engageable with a portion of the sear. The distal portion supports the weight of the sear and the force associated with the sear spring to prevent the sear from falling until desired.

The trigger mechanism comprises a trigger lever pivotally mounted between the plate elements adjacent the sear block at a trigger lever pivot. In this aspect, the proximal portion of the trigger lever is connected with a portion of the trigger.

Actuation of the trigger by the user causes the trigger lever to rotate forward during a first stage. In a second stage, the trigger lever will come into contact with the a portion of the sear block, causing the trigger lever to engage the sear block and move it forward and out of engagement with the sear, which in turn permits the sear to move from the first position to the second position, whereby it falls and permits the actuation of the firing mechanism.

The sear block pivot and trigger lever pivot may be coincident or spaced apart from each other, and adjustment structures may be provided to further optimize the "feel" and durability of the trigger mechanism.

Related methods of operation are also provided. Other apparatuses, methods, systems, features, and advantages of the multi-stage trigger mechanism will be or become apparent to one with skill in the art upon examination of the following figures and detailed description. It is intended that all such additional apparatuses, methods, systems, features, and advantages be included within this description, be within the scope of the multi-stage trigger mechanism, and be protected by the accompanying claims.

DESCRIPTION OF THE FIGURES

The accompanying drawings, which are incorporated in and constitute a part of this specification, illustrate certain aspects of the instant invention and together with the description, serve to explain, without limitation, the principles of the invention. Like reference characters used therein indicate like parts throughout the several drawings.

DESCRIPTION OF THE INVENTION

Figure 1:
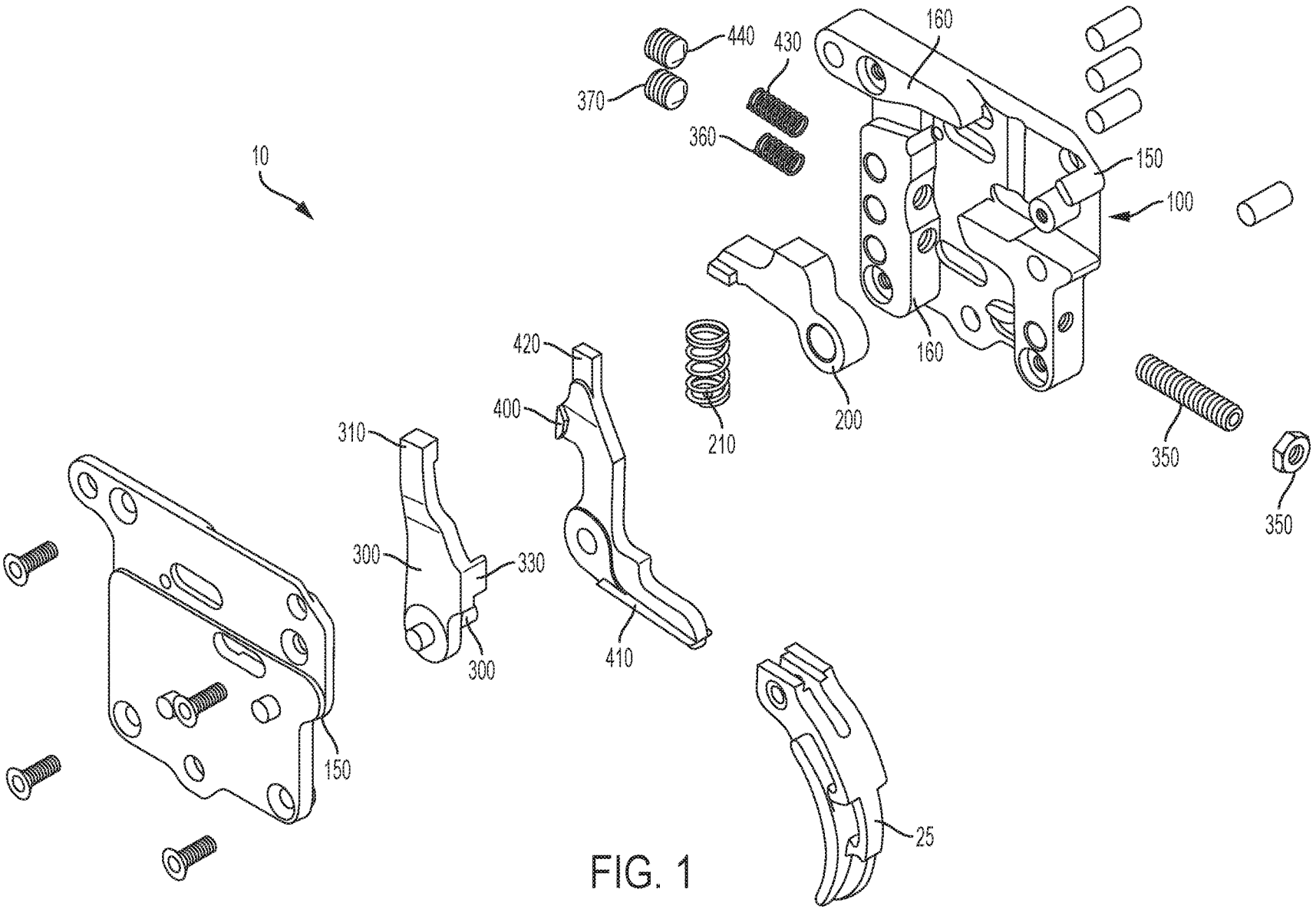
FIG. 1 is an exploded perspective view of one aspect of a trigger mechanism.
Figure 2:
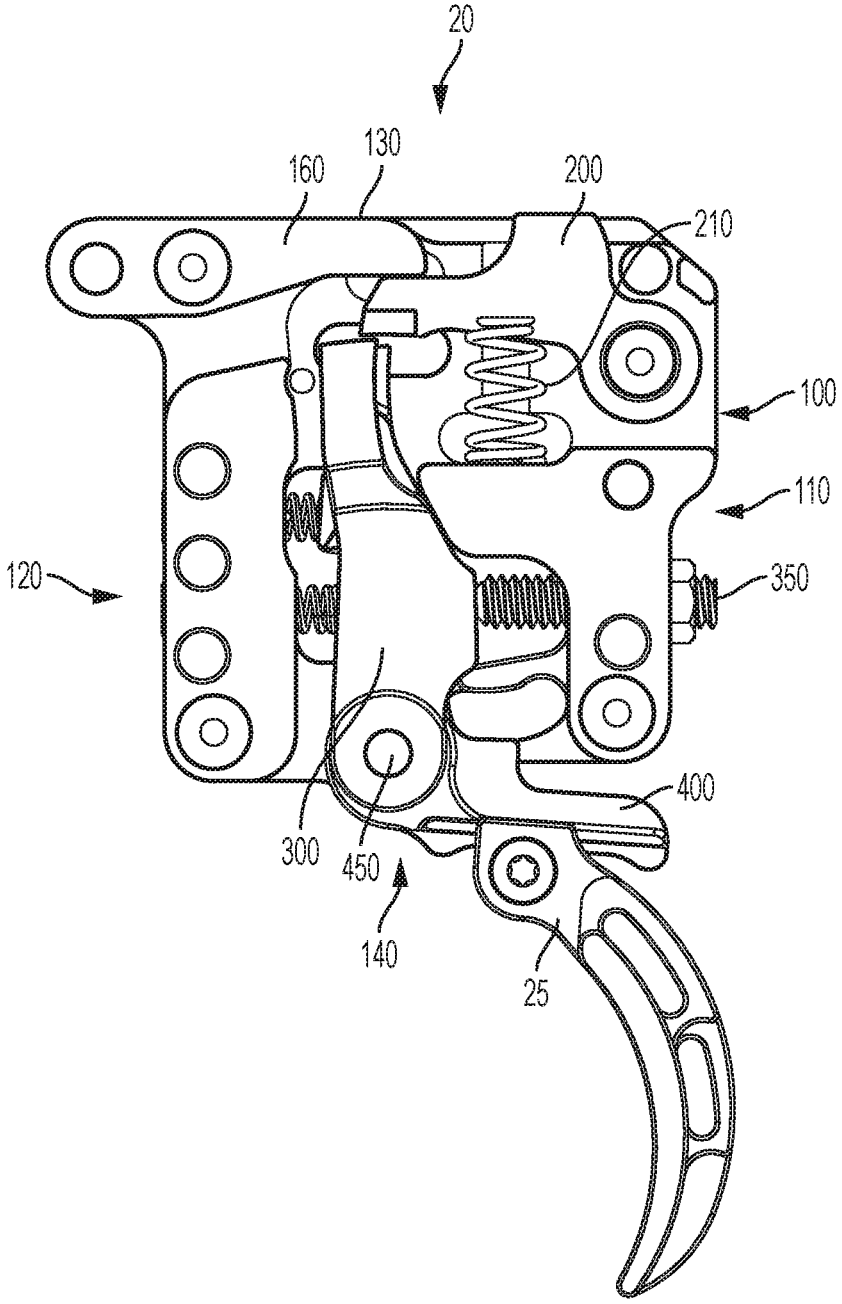
FIG. 2 is a partially transparent side view of the trigger mechanism of FIG. 1.
Figure 3:
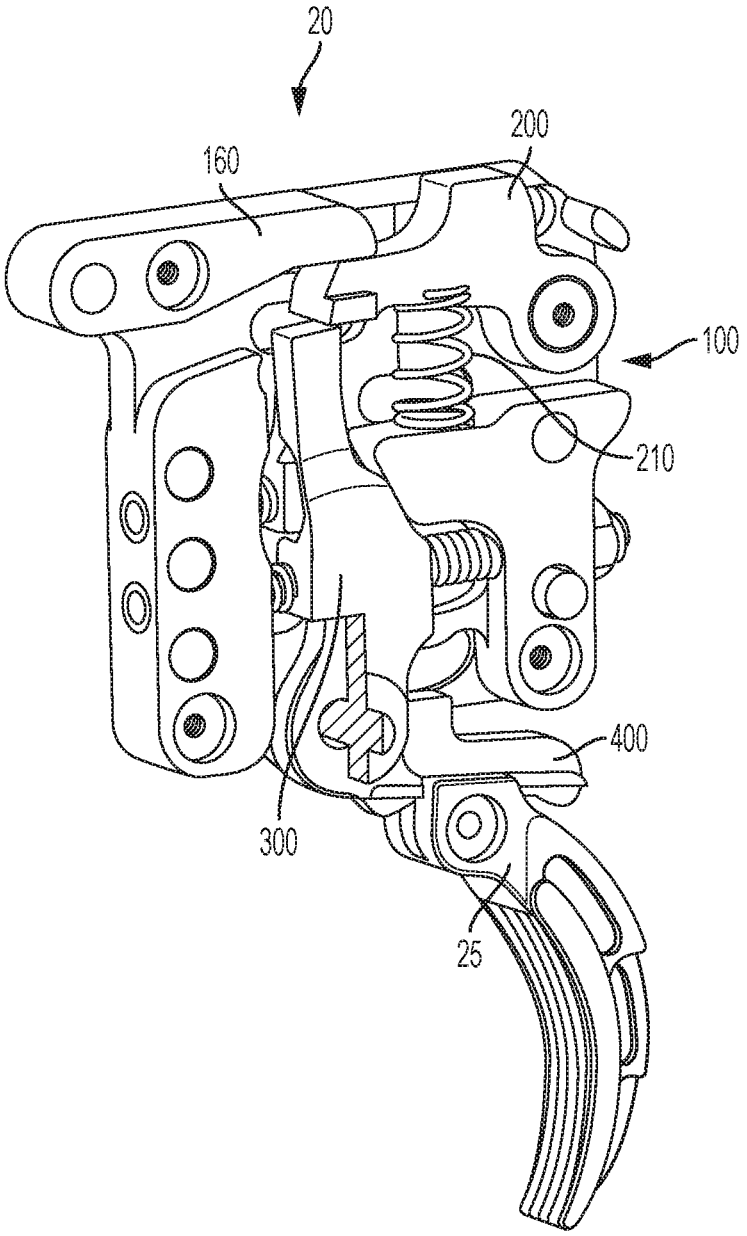
FIG. 3 is a partially transparent perspective view of the trigger mechanism of FIG. 1.
Figure 4:
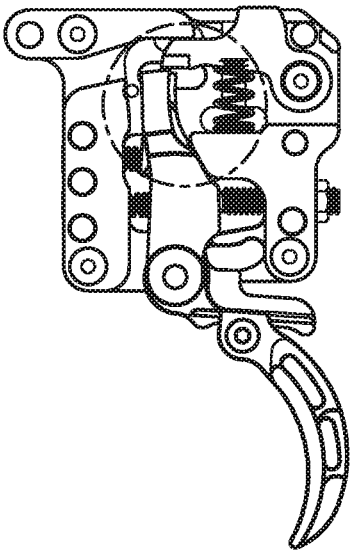
FIG. 4 is a partially transparent side view of the trigger mechanism of FIG. 1 with the sear in a first position, associated with a cocked firing mechanism.
Figure 4A:
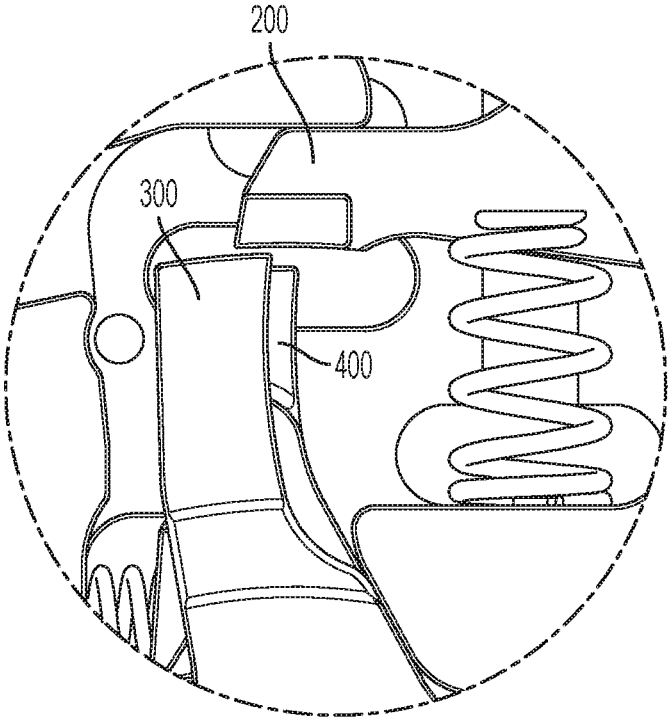
FIG. 4*a* is a section view of section 4*a* of FIG. 4, showing the sear block and trigger lever prior to being actuated by the trigger.
Figure 5:
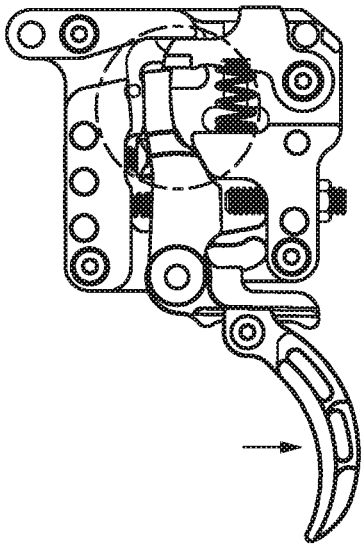
FIG. 5 is a partially transparent side view of the trigger mechanism of FIG. 1 with the sear still in the first position.
Figure 5A:
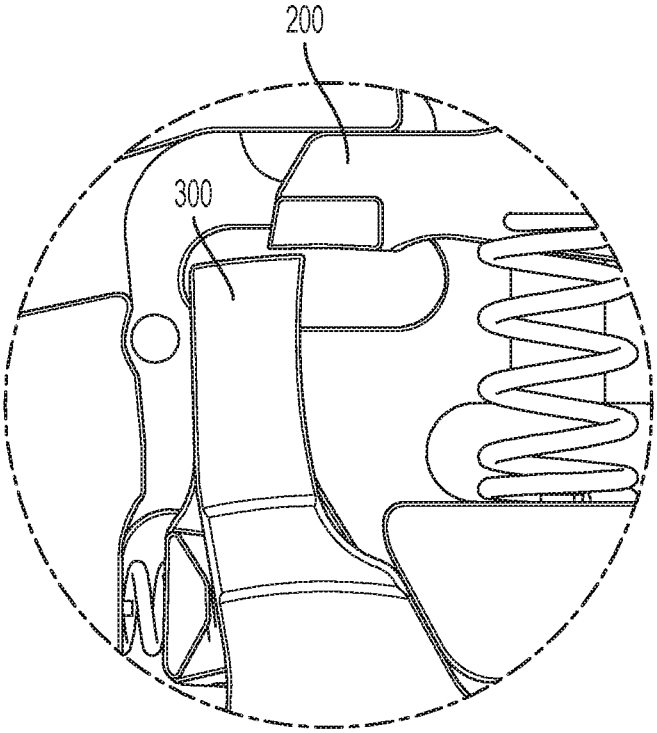
FIG. 5*a* is a section view of section 5*a* of FIG. 5, showing the trigger lever moved forward and the sear block still in engagement with the sear.
Figure 6:
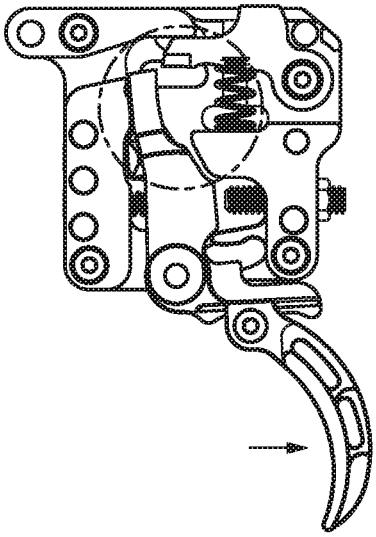
FIG. 6 is a partially transparent side view of the trigger mechanism of FIG. 1, showing the sear moving into the second position and about to drop.
Figure 6A:
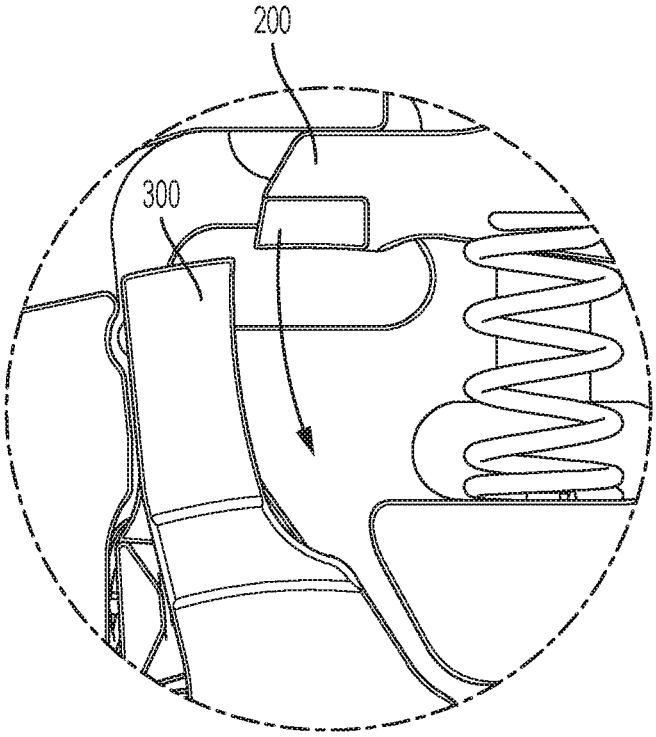
FIG. 6*a* is a section view of section 6*a* of FIG. 6, showing the trigger lever and the sear block moved forward and out of engagement with the sear.
Figure 7:
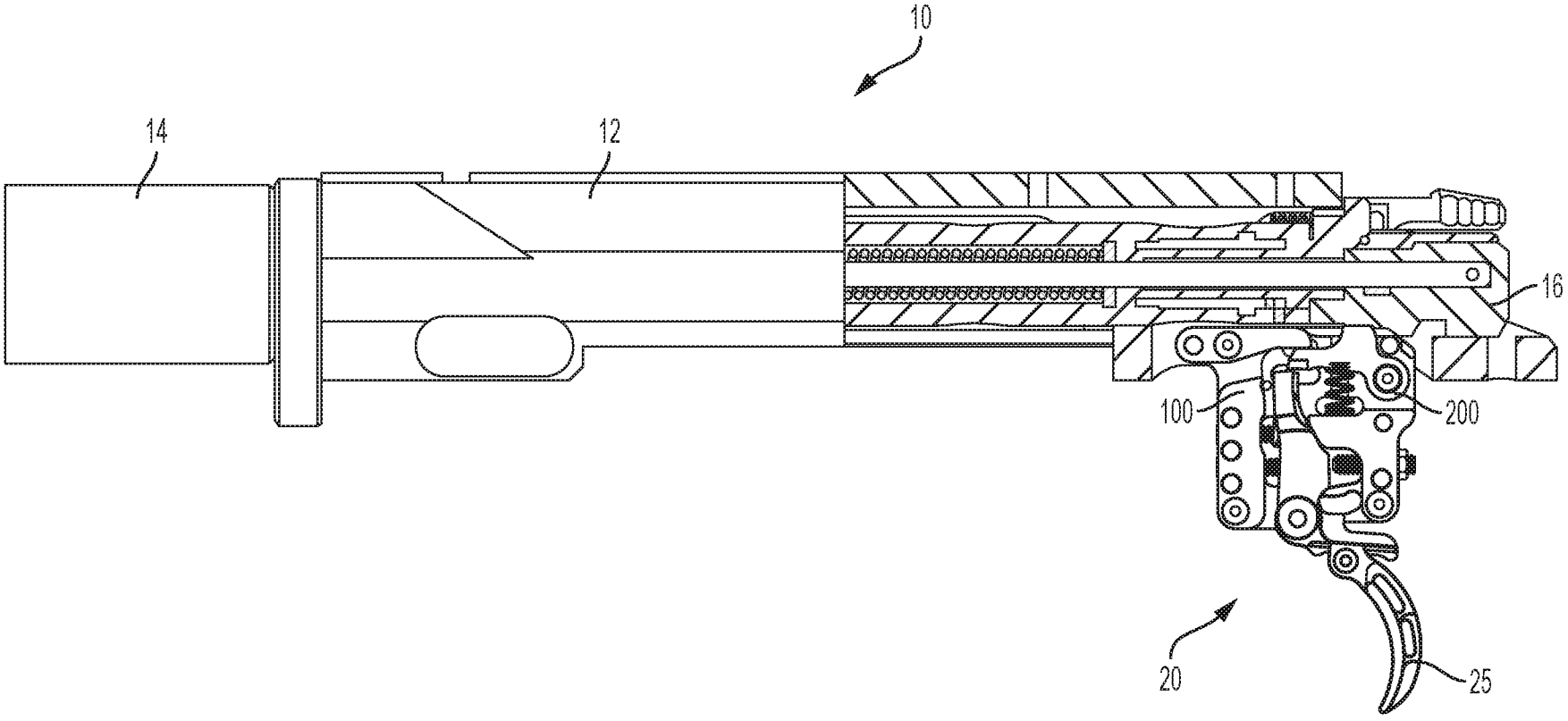
FIG. 7 is a firearm having the trigger mechanism of FIG. 1.
Figure 8:
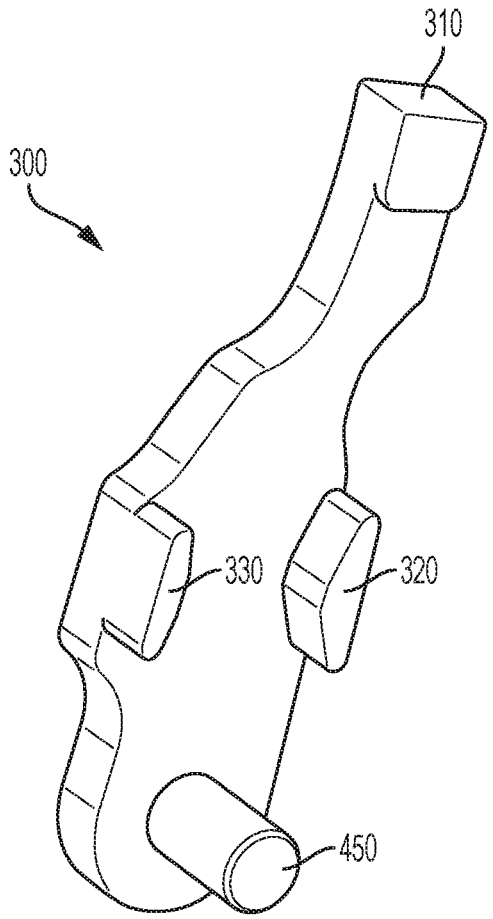
FIG. 8 is a perspective view of a sear associated with the trigger mechanism of FIG. 1.
Figure 9:
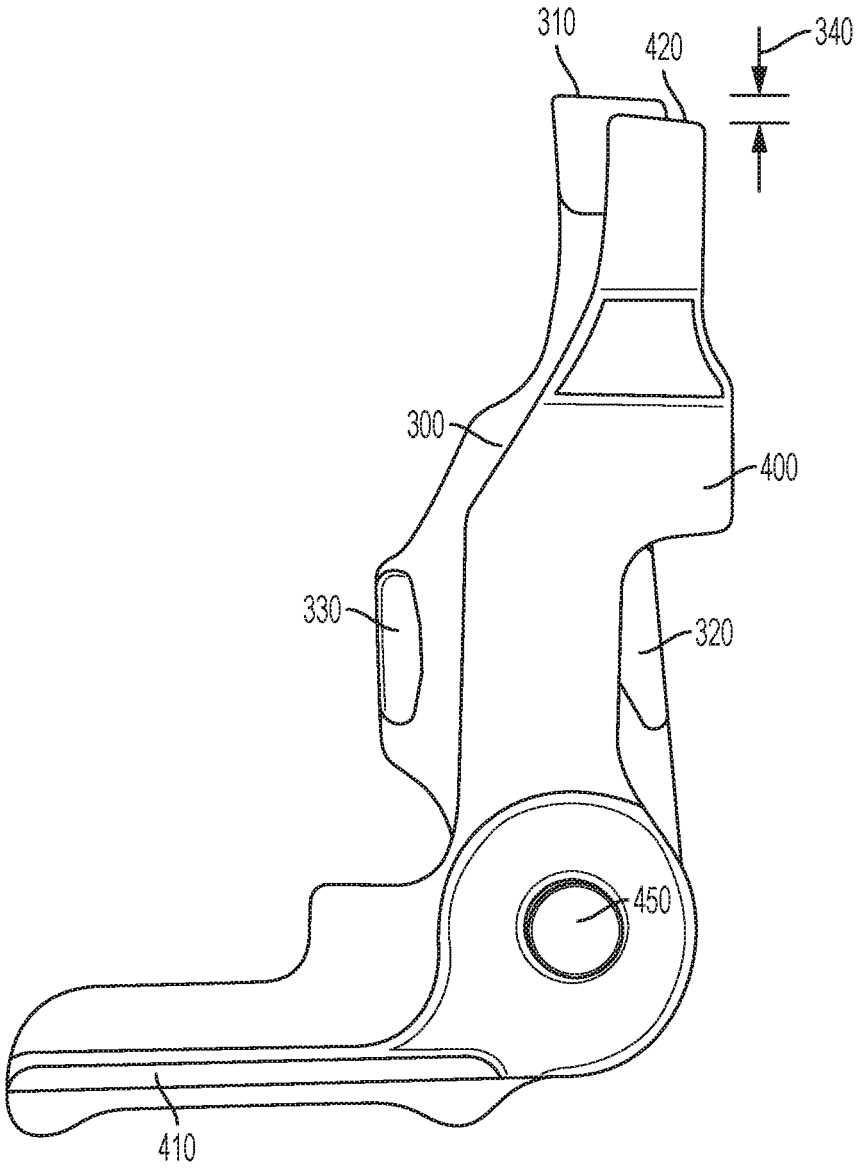
FIG. 9 is a side view of the sear block and the trigger lever of the trigger mechanism of FIG. 1.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "bolt" includes aspects having two or more bolts unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Terms used herein, such as "exemplary" or "exemplified," are not meant to show preference, but rather to explain that the aspect discussed thereafter is merely one example of the aspect presented.

Additionally, as used herein, relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

In one aspect, presented herein is trigger mechanism 20 for a firearm 10. A first preferred trigger mechanism 20 embodiment is shown in FIGS. 1-9, and an alternative preferred trigger mechanism 20' embodiment is shown in FIGS. 10A-D. In one aspect, the firearm 10 is a bolt action rifle having a frame 12, a barrel 14 attached to the frame, a firing mechanism 16 and a trigger mechanism 20.

Referring to the first preferred embodiment of FIGS. 1-9, the trigger mechanism 20 preferably comprises a trigger housing 100 having a front 120, back 110, top 130, and bottom 140. In this aspect, the trigger housing 100 has two spaced side plate elements 150 mountable below the firing mechanism. The trigger mechanism also comprises a trigger assembly body 160 therebetween a portion of the two spaced vertical plate elements;

The trigger mechanism also has a sear 200 pivotally mounted between the plate elements and releasably engagable with a portion of the firing mechanism 16. The sear 200 is moveable between a first position wherein the sear secures the firing mechanism in a cocked position and a second position wherein the sear permits the firing mechanism 16 (FIG. 7) to be released. As can be seen in the figures, the sear sits below the firing mechanism 16 such that, when the sear 200 drops, the firing mechanism is permitted to release and strike the primer.

In an exemplified aspect, the trigger mechanism 20 comprises a sear block 300 pivotally mounted between the plate elements and has a distal portion 310 releasably engageable with a portion of the sear 200. The distal portion 310 supports the weight of the sear 200 and the force associated with the sear spring 210 to prevent the sear from falling until desired. The sear block 300 has at least one tab 320 extending therefrom the side face of the sear block. The tab 320 acts as a stop for the trigger lever 400 discussed below.

The trigger mechanism, in another aspect, comprises a trigger lever 400 pivotally mounted between the plate elements adjacent the sear block in side-by-side relation. In this aspect, the proximal portion 410 of the trigger lever is connected with a portion of the trigger 25. The pivot point 450 of the trigger lever and the sear block 300 are substantially the same, in this aspect. In yet another aspect, the trigger lever's distal portion 420 extends upwardly a predetermined distance 340 that is less than the distal portion 310 of the sear block. In one aspect, the distal portion 310 of the sear block extends upward a predetermined distance 340 between about 0.007" and about 0.025" more than the distal portion 420 of the trigger lever 400. In another aspect, the predetermined distance is between about 0.01" and about 0.02". And, in still another aspect, the predetermined distance is about 0.015". Additionally, in this aspect, a portion of the distal portion 420 of the trigger lever is positioned rearward of the distal portion 310 of the sear block 300. In one aspect, a portion of the distal portion of the trigger lever is positioned between about 0.040" and about 0.085" more rearward than the sear block. In another aspect, a portion of the distal portion of the trigger lever is positioned about between about 0.050" and about 0.065" more rearward than the sear block. In yet another aspect, a portion of the distal portion of the trigger lever is positioned about 0.055" more rearward than the sear block.

In one exemplified aspect, the trigger mechanism also has an adjustment mechanism 350 attached to the trigger assembly body 160. The adjustment mechanism 350 is engageable with a portion of the sear block and is used to adjust the sear block in the rearward-forward direction. In this aspect, the trigger assembly body defines a threaded aperture and the adjustment mechanism is a screw. The distal end of the screw engages a portion of the sear block, as shown in the figures.

As can be appreciated, positioning of the trigger lever 400 when the firearm is in the cocked position is maintained by biasing the trigger lever in the rearward direction. In one aspect, the trigger mechanism 20 has a trigger lever bias element 430 in engagement with the trigger lever 400. The trigger lever bias element 430 is configured to exert a force on the trigger lever in the rearward direction to resist movement of the trigger lever in the forward direct. In another aspect, there can be a trigger lever set screw 440 positioned within a portion of trigger assembly body and in engagement with the trigger lever bias element to adjust the force exerted on the trigger lever 400. The trigger assembly body 160 can define a threaded aperture through with the trigger lever set screw 440 can be positioned in order to adjust the level of compression of the trigger level bias element. In yet another aspect, the trigger lever bias element is a spring. It is contemplated that the trigger level bias element can also be an elastomer or other element with spring like qualities.

As can be appreciated, positioning of the sear block 300 when the firearm is in the cocked position is maintained by biasing the sear block in the rearward direction. In one aspect, the trigger mechanism has a sear block bias element 360 in engagement with the sear block 300. The sear block bias element 360 is configured to exert a force on the sear block in the rearward direction to resist movement of the sear block in the forward direct. In another aspect, there can be a sear block set screw 370 positioned within a portion of trigger assembly body and in engagement with the sear block bias element to adjust the force exerted on the sear block 300. The trigger assembly body can define a threaded aperture through with the sear block set screw 370 can be positioned in order to adjust the level of compression of the trigger level bias element. In yet another aspect, the sear block bias element is a spring. It is contemplated that the trigger level bias element can also be an elastomer or other element with spring like qualities.

In use, actuation of the trigger by the user causes the trigger lever 400 to rotate forward toward the at least one tab 320 of the sear block 300. At some point, the trigger lever will come into contact with the tab 320. As such, further actuation of the trigger causes the trigger lever to engage the tab and move the sear block 300 forward and out of engagement with the sear, which in turn permits the sear 200 to move from the first position to the second position, whereby it falls and permits the actuation of the firing mechanism. After firing, the sear is move back into engagement with the firing mechanism 16 by the sear spring 210, the sear block is moved back under the sear 200 by the sear block spring, and the trigger lever is moved back under the sear by the trigger lever spring. The trigger lever is prevented from moving to far rearward, in one aspect, by a second tab 330 on the sear block configured as a stop for the trigger lever.

Referring to FIGS. 10A-D, an alternative trigger mechanism 20' is shown. Like elements with the first preferred embodiments are shown and numbered the same herein. To avoid undue repetition, discussion of those elements that perform substantially the same function with substantially the same structures between the two embodiments are not repeated herein.

The alternative trigger mechanism 20' of this embodiment comprises a trigger lever 400' pivotally mounted between the plate elements adjacent the sear block 300' in side-by-side relation. In one aspect, the trigger lever can be rotatably coupled to a first pivot point, and the sear block can be rotatably coupled to a second pivot point so that the trigger lever 400' and the sear block 300' can rotate about separate pivots. In this aspect, a trigger lever pivot point 450*a* and a sear block pivot point 450*b* can be spaced apart from each other by a defined distance. In another aspect, the trigger lever pivot point 450*a* and the sear block pivot point 450*b* can be substantially parrallelly aligned.

As can be appreciated, positioning of the trigger lever 400' when the firearm is in the cocked position is maintained by biasing the trigger lever in the rearward direction. In one aspect, the alternative trigger mechanism 20' has a trigger lever bias element 360 in engagement with the trigger lever 400'. The trigger lever bias element 360 is configured to exert a force on the trigger lever in the rearward direction to resist movement of the trigger lever in the forward direct. In another aspect, there can be a trigger lever set screw 370 positioned within a portion of trigger assembly body and in engagement with the trigger lever bias element to adjust the force exerted on the trigger lever 400'. The trigger assembly body 160 can define a threaded aperture through which the trigger lever set screw 370 can be positioned in order to adjust the level of compression of the trigger level bias element 360. In yet another aspect, the trigger lever bias element is a spring. It is contemplated that the trigger level bias element can also be an elastomer or other element with spring like qualities.

As can be appreciated, positioning of the sear block 300' when the firearm is in the cocked position is maintained by biasing the sear block in the rearward direction. In one aspect, the trigger mechanism has a sear block bias element 430 in engagement with the sear block 300'. The sear block bias element 430 is configured to exert a force on the sear block in the rearward direction to resist movement of the sear block in the forward direct. In another aspect, there can be a sear block set screw 440 positioned within a portion of trigger assembly body and in engagement with the sear block bias element to adjust the force exerted on the sear block 300'. The trigger assembly body 160 can define a threaded aperture through with the sear block set screw 440 can be positioned in order to adjust the level of compression of the sear block bias element. In yet another aspect, the sear block bias element 430 is a spring. It is contemplated that the sear block bias element can also be an elastomer or other element with spring like qualities.

Figure 10A:
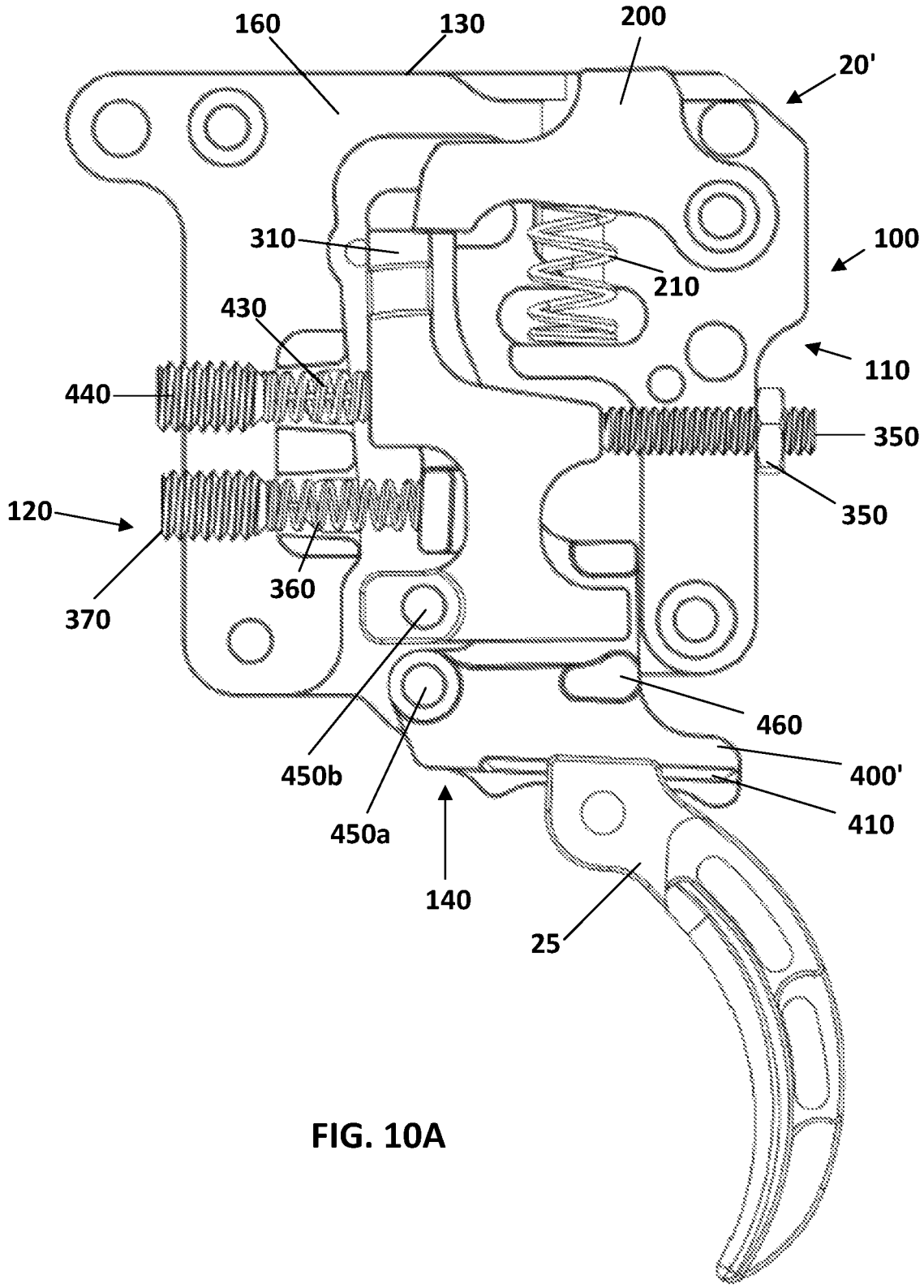
FIG. 10A is a side plan view of an alternative trigger mechanism showing the sear block and trigger lever prior to being actuated by the trigger in accordance with an alternative embodiment.

The alternative trigger mechanism 20' is shown in a neutral, unengaged, position in FIG. 10A wherein the trigger lever 400' does not engage or otherwise contact the sear block 300'. In use, a user moves the trigger 25 in the direction of arrow A (FIG. 10B) thereby causing the trigger lever 400' to pivot about the trigger lever pivot point 450*a* in the direction of arrow B and toward the sear block 300'. That is, movement of the trigger in the direction of arrow A (rearward in FIG. 10B) causes the trigger lever to rotate in a first rotation direction (counter-clockwise in FIG. 10B). Preferably, a protruding tab 460 spaced apart from the trigger lever pivot point 450*a* extends from the trigger lever 400' and operably engages a portion of the sear block 300' as shown when the trigger is moved in the direction of arrow A. This movement of the trigger lever 400' from the neutral position shown in FIG. 10A to the position wherein the protruding tab 460 on the trigger lever 400' first contacts the sear block 300' offers a first defined resistance or "feel" to the user thereby defining a first stage of the trigger mechanism 20' activation.

Figure 10B:
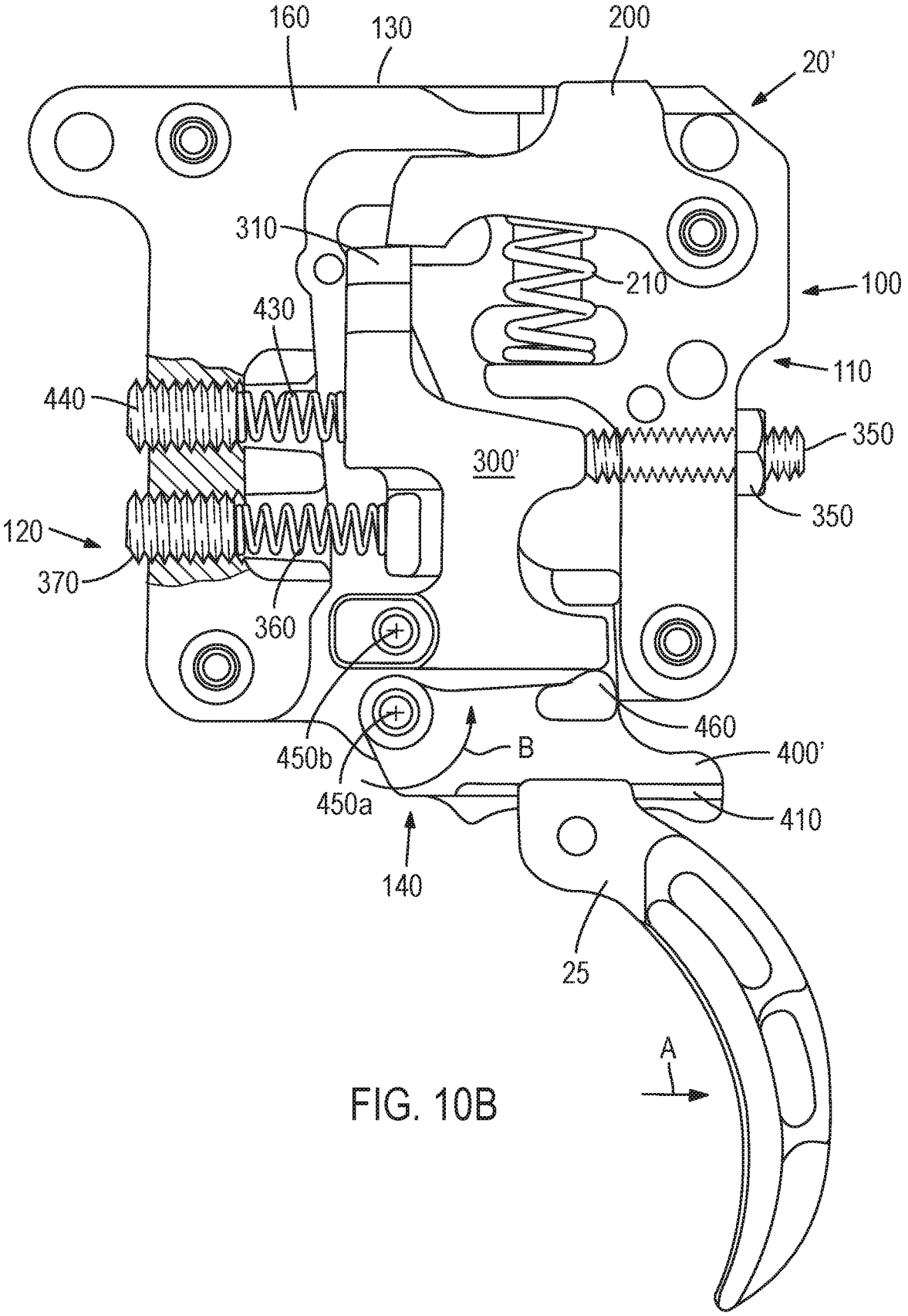
FIG. 10B is a side plan view of the alternative trigger mechanism of FIG. 10A showing the trigger lever moved forward and the sear block still in engagement with the sear.
Figure 10C:
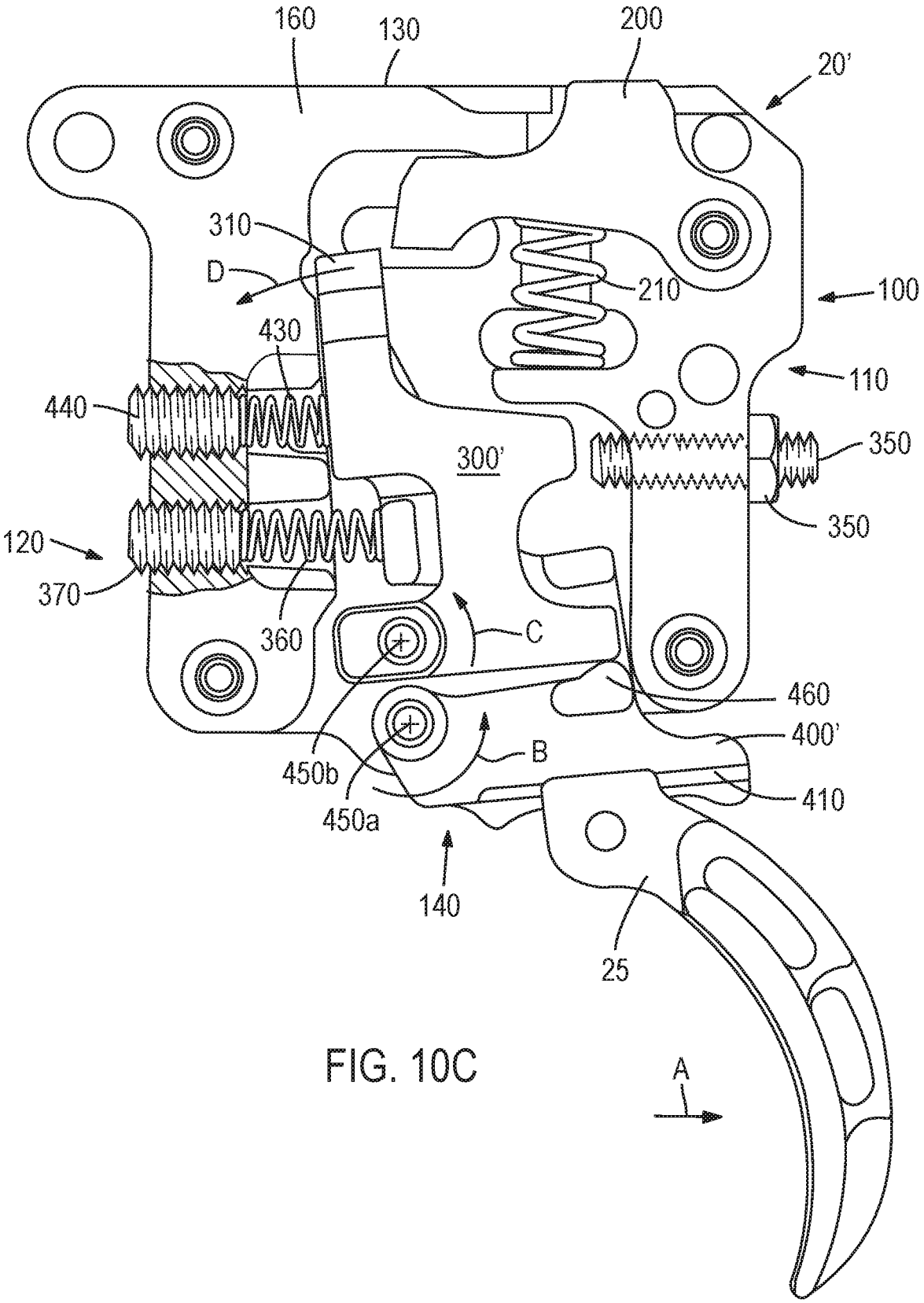
FIG. 10C is a side plan view of the alternative trigger mechanism of FIG. 10A showing the trigger moved toward a firing position and the sear still in the first position and about to drop; and, FIG. 10D is a side plan view of the alternative trigger mechanism of FIG. 10A showing the trigger moved toward a firing position and the sear dropped.

It can be appreciated that after the protruding tab 460 contacts the sear block 300' in FIG. 10B, if the user continues to urge the trigger in the direction of arrow A, the protruding tab can urge the sear block 300' to pivot about the sear block pivot point 450*b* in the direction of arrow C, as shown in FIG. 10C. That is, movement of the trigger in the direction of arrow A (rearward in FIG. 10C) causes the sear block 300' to rotate in the first rotational direction (counter-clockwise in FIG. 10C). This movement of the sear block 300' about the sear block pivot point 450*b* causes the distal portion 310 of the sear block 300' to move in the direction of arrow D (counter-clockwise in FIG. 10C), away from the sear 200. The movement of the search block 300' about the sear block pivot point 450*b* offers a second defined resistance or "feel" to the user thereby defining a second stage of the trigger mechanism 20' activation. It can be appreciated that the amount of resistance felt by the user between the first and second stages of the trigger mechanism 20' can be different between them, and each can be adjusted and optimized for a particular user.

Figure 10D:
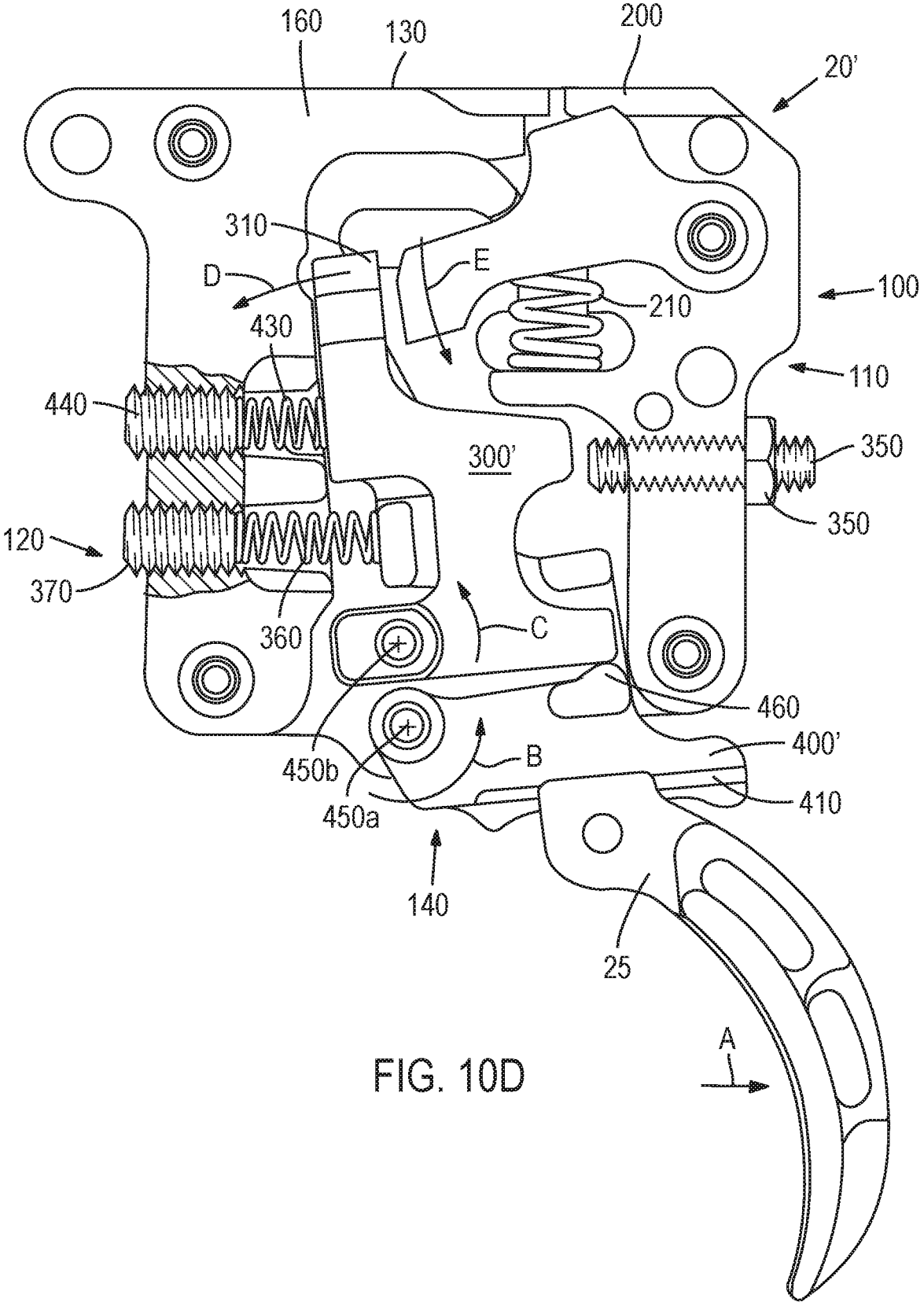

Referring to FIG. 10D, movement of the sear block 300' in the direction of arrow D away from the sear 200 causes the sear to drop in the direction of arrow E. thereby triggering the firing mechanism of the firearm as previously described. That is, movement of the sear block 300' in the first direction away from the sear allows the sear 200 to rotate in the first rotational direction (counter-clockwise in FIG. 10D). After firing, the sear 200 is moved back into engagement with the firing mechanism 16 by the sear spring 210, the sear block 300' is moved back under the sear 200 by the sear block bias element 430, and the trigger lever 400' is moved back under the sear by the trigger lever bias element 360.

In one aspect, spacing the trigger lever pivot point 450*a* and the sear block pivot point 450*b* apart from each other so that the respective trigger lever 400' and sear block 300' pivot about their own pivot points can reduce friction between the engaging portions of the trigger lever and the sear block. In another aspect, spacing the trigger lever pivot point 450*a* and the sear block pivot point 450*b* allows the "feel" of the first and second stage portions of the trigger mechanism 20' to be further fine-tuned and optimized.

Moreover, the protruding tab 460 of the trigger lever 400' can be optimized in both shape and materials to optimize performance and durability. Preferably, the outer engaging surface of the protruding tab 460 can be rounded as best shown in FIG. 10C so as to minimize friction between the protruding tab 460 and sear block 300' throughout the range of movement of the sear block 300'. The protruding tab can be integrally formed within the trigger lever 400' as a monolithic structure, or can be a discrete component formed of durable material or materials that is operably secured to the trigger lever 400'.

Alternatively, in another aspect (not shown), it is contemplated that the protruding tab can be positioned on a portion of the sear block 300'. In this aspect, the trigger lever 400' can define a recess configured to engage a portion of the protruding tab of the sear block. For example, movement of the trigger lever 400' from the neutral position shown in FIG. 10A to a position wherein the recess of the trigger lever first contacts a portion of the protruding tab 460 on the sear block 300' offers a first defined resistance or "feel" to the user thereby defining a first stage of the trigger mechanism 20' activation.

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described invention.

What is claimed is:

1. A trigger assembly for cocking and releasing a firing mechanism of a firearm, the trigger assembly having a trigger and comprising:

a trigger housing having a front, back, top, and bottom, the trigger housing comprising two spaced side plate elements mountable below the firing mechanism and a trigger assembly body therebetween a portion of the two spaced vertical plate elements;

a sear pivotally mounted between the plate elements and releasably engagable with a portion of the firing mechanism and moveable between a first position wherein the sear secures the firing mechanism in a cocked position and a second position wherein the sear permits the firing mechanism to be released;

a sear block pivotally mounted between the plate elements at a sear block pivot and having a distal portion releasably engageable with a portion of the sear; and, a trigger lever configured to engage a proximal portion of the sear block and having a distal portion that extends upwardly a predetermined distance less than the distal portion of the sear block, wherein the trigger lever is pivotally mounted between the plate elements adjacent the sear block at a trigger lever pivot which is spaced apart from the sear block pivot;

wherein, in the cocked position, the trigger lever is out of contact with the sear block and wherein, actuation of the trigger causes the trigger lever to rotate about the trigger lever pivot so that the trigger lever contacts and operably engages the proximal portion of the sear block, causing the sear block to rotate about the sear block pivot and urging the distal portion of the sear block out of engagement with the sear, thereby allowing the sear and the trigger lever to move together from the first position to the second position;

wherein, if the sear block rotates independently and out of engagement with the sear, the sear rotates and contacts the distal portion of the trigger lever.

2. The trigger assembly of claim 1, further including an adjustment mechanism attached to the trigger assembly body, the adjustment mechanism engageable with a portion of the sear block to adjust the position of the sear block relative to the trigger assembly body.

3. The trigger assembly of claim 1, wherein the trigger lever pivot and the sear block pivot are substantially parallel with each other.

4. The trigger assembly of claim 3, wherein the trigger lever comprises a protruding tab extending from the trigger lever.

5. The trigger assembly of claim 4, wherein the protruding tab is spaced apart from the trigger lever pivot a predetermined distance.

6. The trigger assembly of claim 4, wherein the protruding tab has a rounded outer surface for operably engaging a portion of the sear block.

7. The trigger assembly of claim 1, wherein the trigger lever pivot and the sear block pivot are coincident.

8. The trigger assembly of claim 7, wherein the trigger lever comprises a protruding tab positioned rearward of the distal portion of the sear block.

9. The trigger assembly of claim 1, wherein, actuation of the trigger causes the trigger lever to rotate about the trigger lever pivot in a first rotational direction and the sear block to rotate about the sear block pivot in the first rotational direction.

10. The trigger assembly of claim 1, wherein rotation of the sear block in the first direction moves the distal portion of the sear block out of engagement with the sear, thereby urging the sear to move from the first position to the second position in the first rotational direction.

11. A firearm, comprising:

a frame;

a barrel attached to the frame;

a firing mechanism; and a trigger mechanism, comprising:

a trigger housing having a front, back, top, and bottom, the trigger housing comprising two spaced side plate elements mountable below the firing mechanism and a trigger assembly body therebetween a portion of the two spaced vertical plate elements;

a sear pivotally mounted between the plate elements and releasably engagable with a portion of the firing mechanism;

a sear block pivotally mounted between the plate elements at a sear block pivot and having a distal portion releasably engageable with a portion of the sear, the trigger being moveable from an uncocked position with the trigger out of contact with the sear block to a first position wherein the sear secures the firing mechanism in a cocked position with the trigger in contact with the sear block and a second position wherein the sear block and trigger rotate together to permit the firing mechanism to be released; and, a trigger lever configured to engage a proximal portion of the sear block and having a distal portion that extends upwardly a predetermined distance less than the distal portion of the sear block, wherein the trigger lever is pivotally mounted between the plate elements adjacent the sear block at a trigger lever pivot;

wherein, actuation of the trigger causes the trigger lever to rotate about the trigger lever pivot so that the trigger lever operably engages the proximal portion of the sear block causing the sear block to rotate about the sear block pivot and urging the distal portion of the sear and the trigger lever block out of engagement with the sear thereby allowing the sear block and the trigger to move together from the first position to the second position;

wherein, if the sear block rotates independently and out of engagement with the sear, the sear rotates and contacts the distal portion of the trigger lever.

12. The trigger assembly of claim 11, wherein the trigger lever pivot and sear block pivot are spaced apart from each other.

13. The trigger assembly of claim 12, further including an adjustment mechanism attached to the trigger assembly body, the adjustment mechanism engageable with a portion of the sear block to adjust the position of the sear block relative to the trigger assembly body.

14. The trigger assembly of claim 11, wherein the trigger lever pivot and the sear block pivot are parallel with each other.

15. The trigger assembly of claim 14, wherein the trigger lever comprises a protruding tab extending from the trigger lever.

16. The trigger assembly of claim 15, wherein the protruding tab is spaced apart from the trigger lever pivot a predetermined distance.

17. The trigger assembly of claim 15, wherein the protruding tab has a rounded outer surface for operably engaging a portion of the sear block.

18. The trigger assembly of claim 11, wherein the trigger lever pivot and the sear block pivot are coincident.

19. The trigger assembly of claim 18, wherein the trigger lever comprises a protruding tab positioned rearward of the distal portion of the sear block.

* * * * *